US011441372B2

(12) United States Patent
Cotton et al.

(10) Patent No.: US 11,441,372 B2
(45) Date of Patent: Sep. 13, 2022

(54) INWARD BIASED TUBING HANGER

(71) Applicant: Patriot Research Center, LLC, Houston, TX (US)

(72) Inventors: Craig Cotton, Cypress, TX (US); Brandon Cain, Houston, TX (US)

(73) Assignee: Patriot Research Center, LLC, Houston, TX (US)

( * ) Notice: Subject to any disclaimer, the term of this patent is extended or adjusted under 35 U.S.C. 154(b) by 0 days.

(21) Appl. No.: 16/995,303

(22) Filed: Aug. 17, 2020

(65) Prior Publication Data

US 2022/0049562 A1 Feb. 17, 2022

(51) Int. Cl.
*E21B 23/02* (2006.01)
*E21B 43/10* (2006.01)

(52) U.S. Cl.
CPC ..... *E21B 23/02* (2013.01); *E21B 43/10* (2013.01)

(58) Field of Classification Search
CPC ..... E21B 23/02; E21B 43/10; E21B 43/106; E21B 43/08; E21B 33/0415; E21B 43/103; E21B 33/04
See application file for complete search history.

(56) References Cited

U.S. PATENT DOCUMENTS 5,307,879 A * 5/1994 Kent ..... E21B 33/04 166/382
10,132,132 B2 * 11/2018 Robottom ..... E21B 33/0422
2016/0186523 A1 * 6/2016 Nguyen ..... E21B 33/04 166/382
2016/0340984 A1 * 11/2016 Colenutt ..... E21B 17/1071
2018/0258727 A1 * 9/2018 Lim ..... E21B 33/043
2018/0320454 A1 * 11/2018 Cochran ..... E21B 33/0407

* cited by examiner

*Primary Examiner* — D. Andrews
(74) *Attorney, Agent, or Firm* — The Kubiak Law Firm, PLLC

(57) ABSTRACT

An inwardly biased tubing hanger is provided that allows for continued turns in the same direction to both lock the tubing hanger in place within the well as well as release the running tool from the tubing hanger. An energizing sleeve and running tool each having left hand threads is provided where a torque ring between the energizing sleeve and running tool allows the running tool to be turn in the right hand direction until sufficient torque is provided to the torque sleeve to release the running tool from the energizing sleeve. With the running tool attached to the energizing sleeve the energizing sleeve provides sufficient force, provided the torque limit of the torque sleeve is not been reached, to drive the inwardly biased torque ring radially outward.

3 Claims, 9 Drawing Sheets

INWARD BIASED TUBING HANGER

BACKGROUND

When drilling an oil or gas well, initially a large diameter borehole is drilled. At some point it becomes necessary to case the initial large diameter borehole. A length of appropriately sized pipe is positioned in this vertical hole and cement is forced downward into the interior of the pipe and thereafter to flow upwardly in the annular area exterior of the pipe. Anchoring the pipe solidly in the earth. Thereafter, successively smaller boreholes are drilled, cased and cemented until the formation or formations are reached. In order to prepare the cased well for production, a production tubing string is run into the cased borehole. Other tubulars may be placed within the casing and not cemented.

In general, a tubing hanger is installed by a hanger running tool that lowers the hanger down the production bore of the wellhead until it lands on a stop shoulder. The tubing hanger is not cemented. The stop shoulder is formed by a spool, having a decreased inner diameter portion, defining a section of the production bore the wellhead. A locking ring provides a permanent means to stop the tubing hanger thereby locating the hanger within the wellhead.

In prior art tubing hangers having an inwardly biased lock ring is installed. The tubing hanger generally utilizes a running tool above the tubing hanger as an inwardly biased lock ring must be forced radially outward into its locked position within a groove.

The tubing hanger is in run into the hole to the desired position. The running tool is then rotated to drive an inner mandrel into the tubing hanger which then expands the lock ring into its locating slot thereby locking the tubing hanger into place. The running tool is then reverse rotated to unscrew from the tubing hanger mandrel. Unfortunately, in many instances the running tool also partially, or in a worse-case fully, backs the mandrel out of engagement with the lock ring. When the inner mandrel is removed the lock ring moves inward, as it's biased to inward, and moves out of the locking groove, thereby partially releasing the tubing hanger from engagement within the tubing or casing within which it is placed.

SUMMARY

In an embodiment of the current invention a tubing hanger is comprised of an inwardly biased lock ring. The inwardly biased lock ring is placed onto tubing hanger mandrel and is lowered into position until the inwardly biased lock ring reaches a shoulder on a radially outward surface of the tubing hanger mandrel. The shoulder on the radially outward surface of the tubing hanger mandrel prevents the inwardly biased lock ring from moving lower with respect to the tubing hanger mandrel. The inwardly biased lock ring includes an angled radially inward surface. A portion of the tubing hanger mandrel above the inwardly biased lock ring includes a preferably right-hand thread. An energizing sleeve has inner throughbore where the inner surface of the inner throughbore includes a right-hand thread that cooperates with the right-hand thread on the tubing hanger mandrel. The lower end of the energizing sleeve includes on its radially outward lower end, an angled surface that cooperates with the angled radially inward surface on the inwardly biased lock ring. On the radially outward surface of the energizing sleeve, above the angled surface on the radially outward lower end of the energizing sleeve is a left-hand thread. A torque ring is placed around the radially outward surface of the energizing ring and is lowered until it contacts the upper end of the angled surface on the radially outward lower end of the energizing sleeve.

A tubing hanger running tool having a radially inward surface with a left-hand thread that matches the left-hand thread of the radially outward surface of the energizing sleeve is threaded onto the energizing sleeve until the lower end of the tubing hanger running tool contacts the torque ring. The tubing hanger running tool is then further threaded onto the energizing sleeve squeezing the torque ring between the upper end of the angled surface on the radially outward lower end of the energizing sleeve and the lower end of the tubing hanger running tool. The tubing hanger running tool is threaded on until the desired torque specification is reached. Preferably about 300 pounds of torque is required to reach the desired specification. As the torque ring is compressed between the energizing sleeve and the tubing hanger running tool the torque values go up as the torque ring is further compressed.

The tubing hanger running tool, the energizing sleeve, and torque ring that are made up into a first assembly as described above are then threaded onto the tubing hanger mandrel via the right-hand threads on the tubing hanger mandrel and inner surface of the energizing sleeve. The first assembly is threaded onto the tubing hanger mandrel until the angled surface on the radially outward lower end of the energizing sleeve contacts the angled surface on the inward biased lock ring. With the radially outward lower end of the energizing sleeve and the angled surface on the inward biased lock ring in contact with one another a torque key is placed within a groove partially within the energizing sleeve and partially within the inward biased lock ring. The torque key prevents undesired rotational movement between the energizing sleeve and the inward biased lock ring.

The tubing hanger is then run into a well to the desired location. The tubing hanger is then locked in position by rotating to the right the first assembly. The tubing hanger running tool, the energizing sleeve, and the torque ring continue to turn together as the first assembly provided that the previously set torque specification, preferably 300 foot-pounds of torque, is not exceeded. As the first assembly is rotated to the right the right-hand threads on the tubing hanger mandrel and the inner surface of the energizing sleeve cooperate to drive the energizing sleeve downward with respect to the tubing hanger mandrel. As the inwardly biased lock ring is prevented from moving lower with respect to the tubing hanger mandrel the angled surfaces on each of the energizing sleeve and the inwardly biased lock ring cooperate to provide a radially outward directed force as the energizing sleeve moves downward. The radially outward directed force moves the inwardly biased lock ring radially outward into a groove in the tubular within which the tubing hanger has been located. Upon the inwardly biased lock ring being fully expanded into the groove, the inwardly biased lock ring will resist further radially outward expansion and thereafter resists the energizing ring from moving lower with respect to the tubing hanger mandrel. With the energizing sleeve prevented from moving lower with respect to the mandrel the torque required to turn the running tool to the right increases. Once the torque value exceeds the torque specification on the torque ring, the torque ring releases the tubing hanger running tool and the tubing hanger running tool begins to turn on the left hand threads of the energizing sleeve until sufficient right hand turns of the left hand threads between the energizing sleeve in the tubing hanger running tool releases the tubing hanger running tool from the energizing sleeve and the tubing hanger running tool may be removed to the surface leaving the tubing hanger locked in place. It is envisioned that the torque sleeve is an elastomer however any material that may be deformed within in its plastic deformation limits, such as a spring, may be used. Shear pins may also be used provided that the cumulative shear force may be calculated as a torque.

Generally, while right hand threads were described in the description above, left or right hand threads may be utilized provided each thread set cooperates with the preceding thread set as described above.

DETAILED DESCRIPTION

The description that follows includes exemplary apparatus, methods, techniques, or instruction sequences that embody techniques of the inventive subject matter. However, it is understood that the described embodiments may be practiced without these specific details. When referring to the top of the device or component top is towards the surface of the well. Side is radially offset from a component but minimally longitudinally offset.

Figure 1:
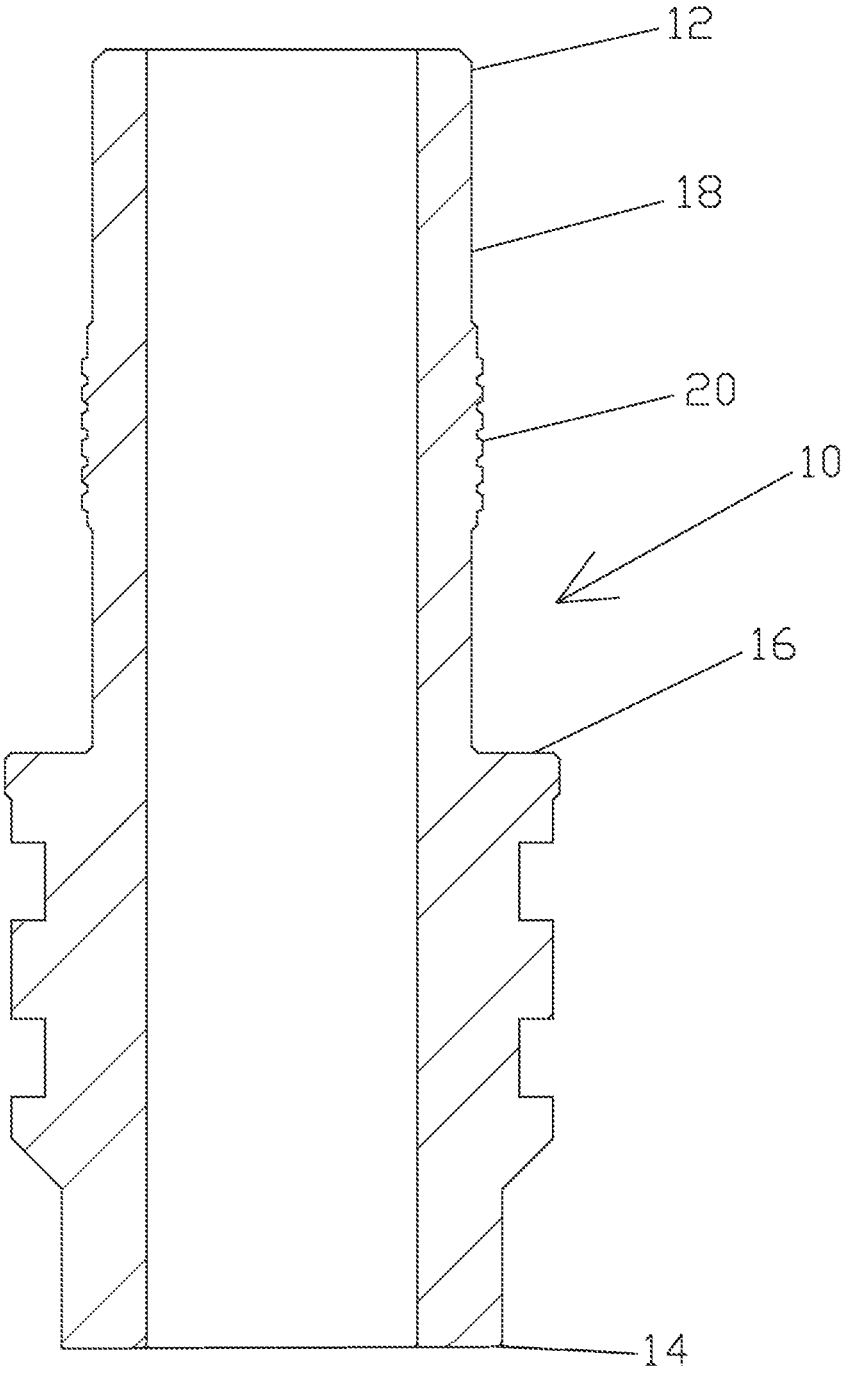
FIG. 1 depicts a side cutaway view of the tubing hanger mandrel.

FIGS. 1-9 depict the various pieces and assemblies of an inwardly biased tubing hanger of the present invention. FIG. 1 is a side cutaway view of the tubing hanger mandrel 10. The tubing mandrel 10 has an upper end 12, a lower end 14, a radially outward surface 18, a shoulder 16, and a right hand thread 20. The right hand thread 20 is located on the radially outward surface 18 between the shoulder 16 in the upper end 12 of the tubing hanger mandrel 10.

Figure 2:
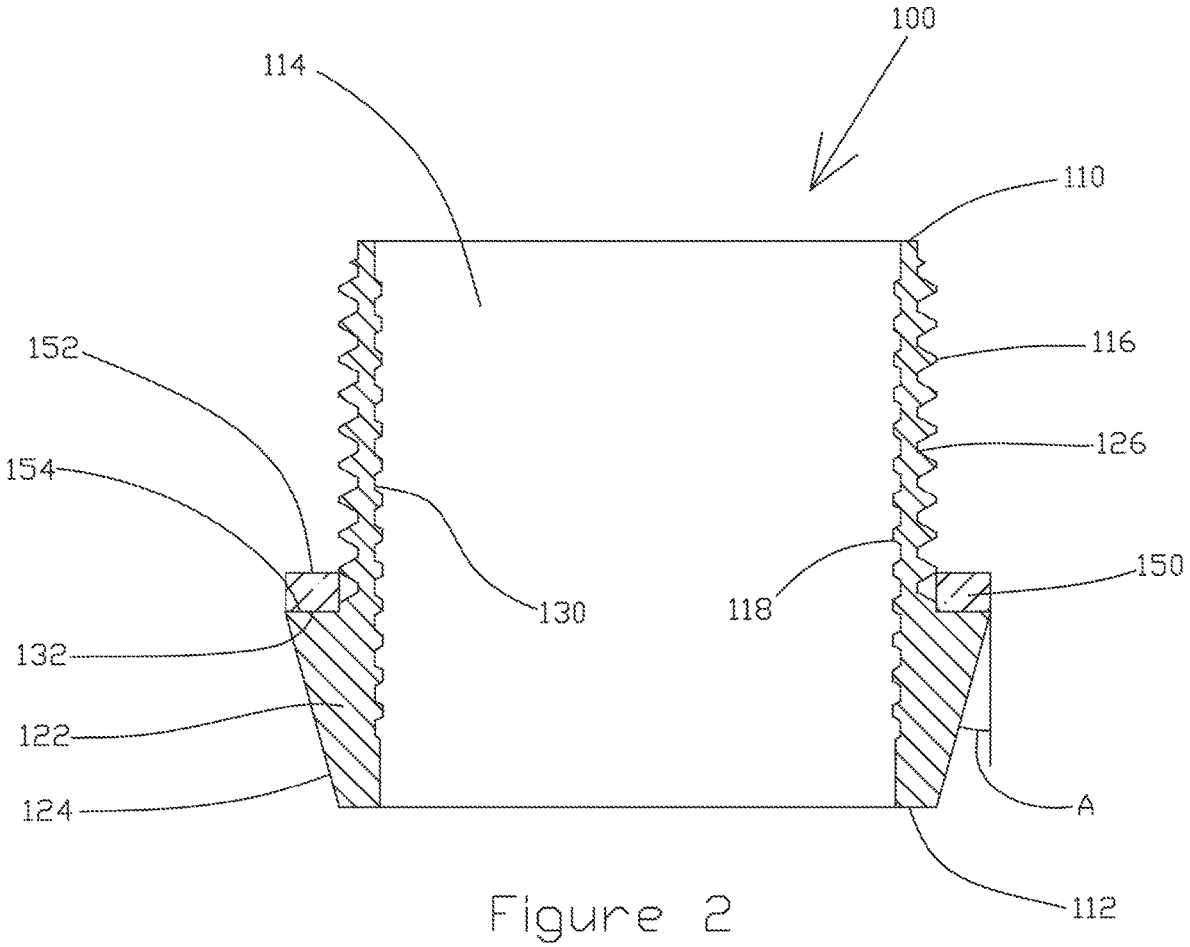
FIG. 2 depicts a side cutaway view of the energizing sleeve and torque ring.

FIG. 2 is a side cutaway view of the energizing sleeve 100 with a torque ring 150. The energizing sleeve 100 has an upper end 110, a lower end 112, a throughbore 114, a radially outward surface 116, and a radially inward surface 118. Towards the lower end 112 of the radially outward surface 116 is a protrusion 122. The radially outward surface of the protrusion 124 is at an angle A. The upper end of protrusion 122 forms a shoulder 132. On the radially outward surface 116 is a set of left hand threads 126 where the left hand threads 126 are located between the protrusion 122 and the upper end 110 of the energizing sleeve 100. On the radially inward surface 118 of the energizing sleeve 100 is a set of right hand threads 130. The right-hand threads 130 of the radially inward surface 118 of the energizing sleeve 100 match the right hand threads 20 on the tubing hanger mandrel 10 from FIG. 1. The torque ring 150 is placed over the energizing sleeve 100 and is lowered from the upper end 110 of the energizing sleeve 100 until the lower end 154 of the torque ring 150 abuts shoulder 132 of the energizing sleeve 100.

Figure 3A:
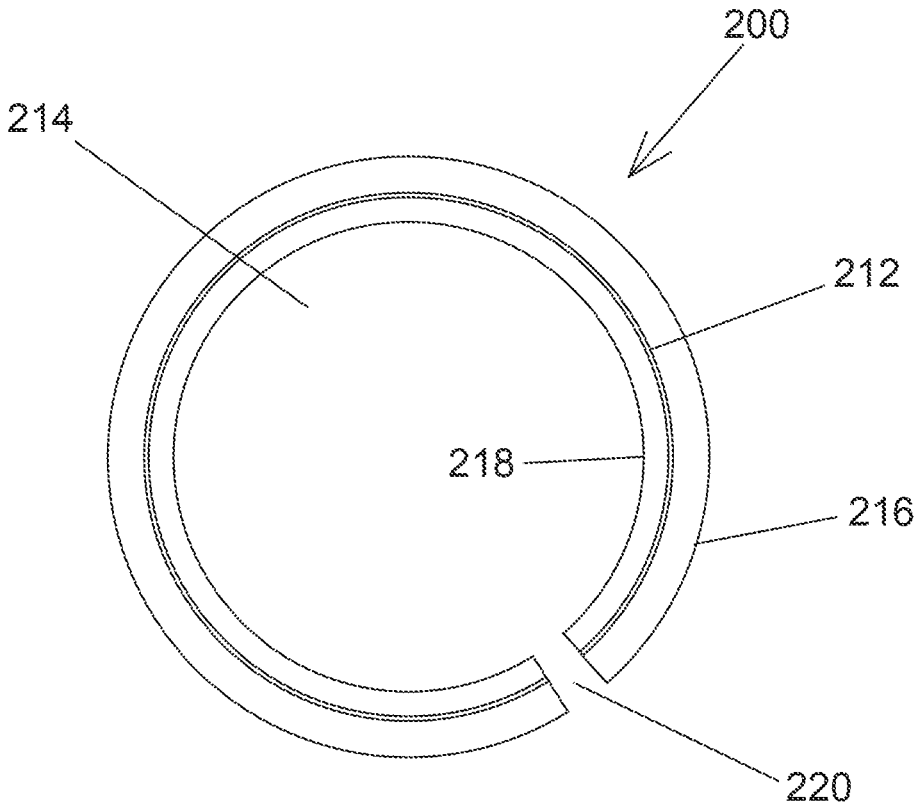
FIG. 3A depicts a top view of the inwardly biased lock ring
Figure 3:
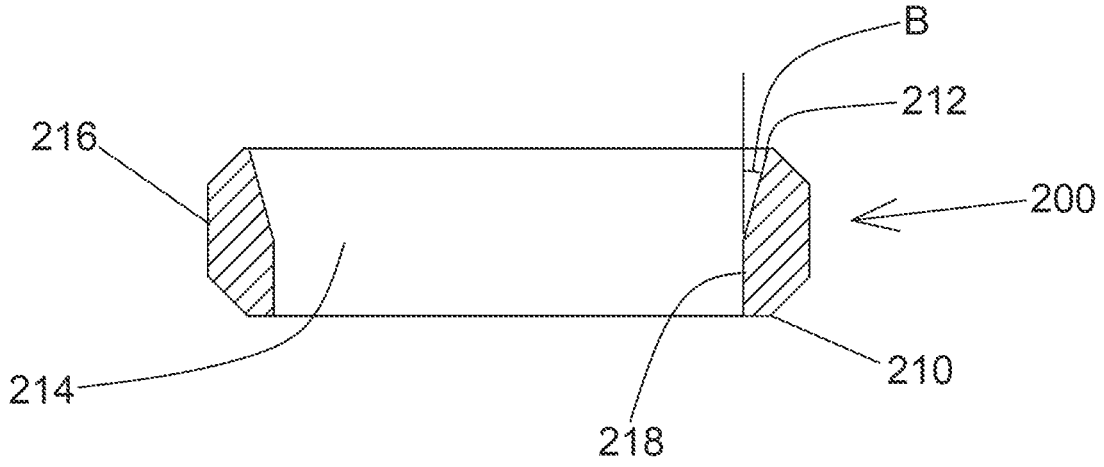
FIG. 3 depicts a side cutaway view of an inwardly biased lock ring.

FIG. 3 is a side cutaway view of an inwardly biased lock ring 200. The inwardly biased lock ring 200 has a lower end 210, an upper end 212, a throughbore 214, a radially outward surface 216 and a radially inward surface 218. Towards the upper end 212 of the radially inward surface 218 at least a portion of the radially inward surface 218 is at an angle B. Angles A and B are between 15 and 40 degrees but more preferably are 25 degrees.

FIG. 3A is a top view of the inwardly biased lock ring 200. A discontinuity or gap 220 allows the inwardly biased lock ring to expand radially outward.

Figure 4:
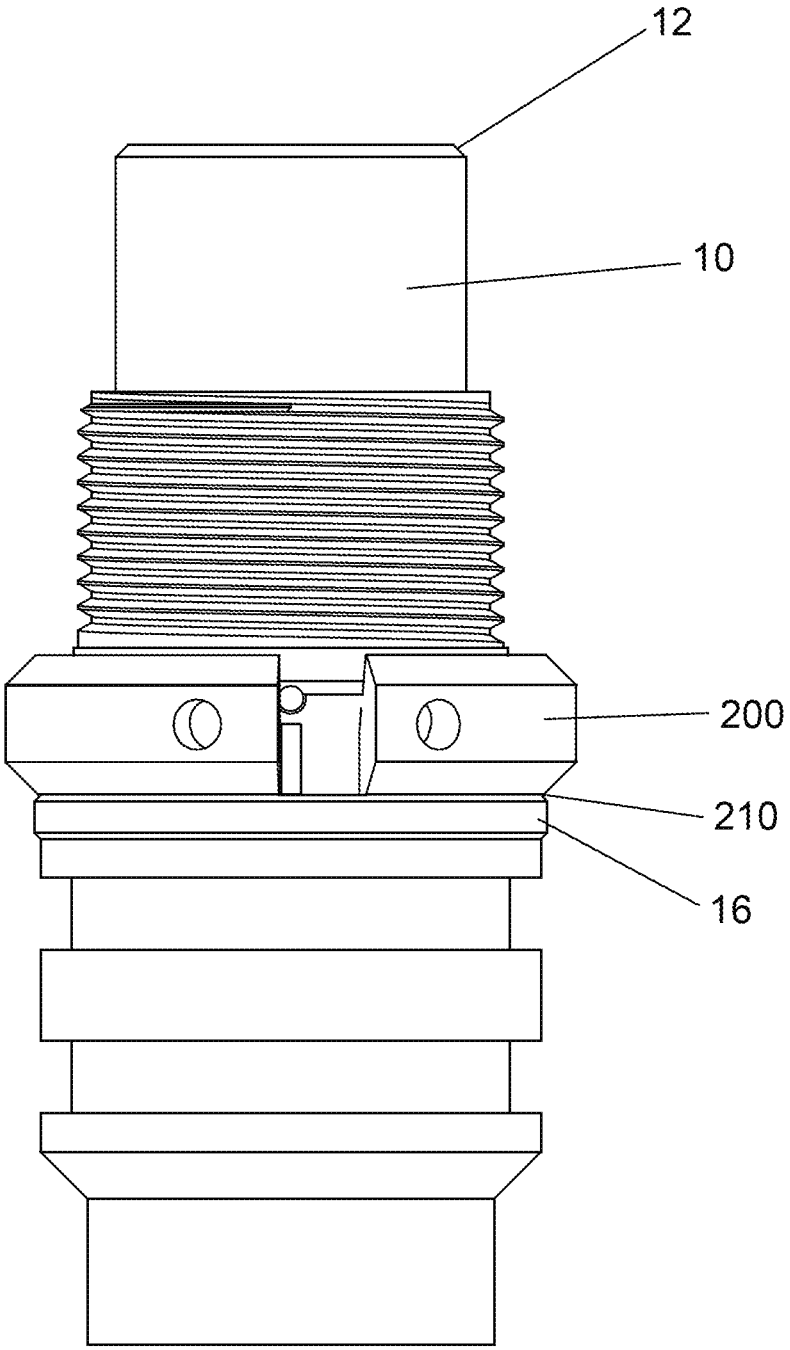
FIG. 4 depicts a side view of the tubing hanger mandrel with the inwardly biased lock ring in position on the mandrel shoulder.

FIG. 4 is a side view of the tubing hanger mandrel 10 where the inwardly biased lock ring 200 has been placed on the mandrel 10 and then lowered onto the mandrel 10 from the upper end 12 toward shoulder 16. The inwardly biased lock ring 200 is lowered in place until the lower end 210 of the inwardly biased lock ring 200 abuts shoulder 16 of the tubing hanger mandrel 10.

Figure 5:
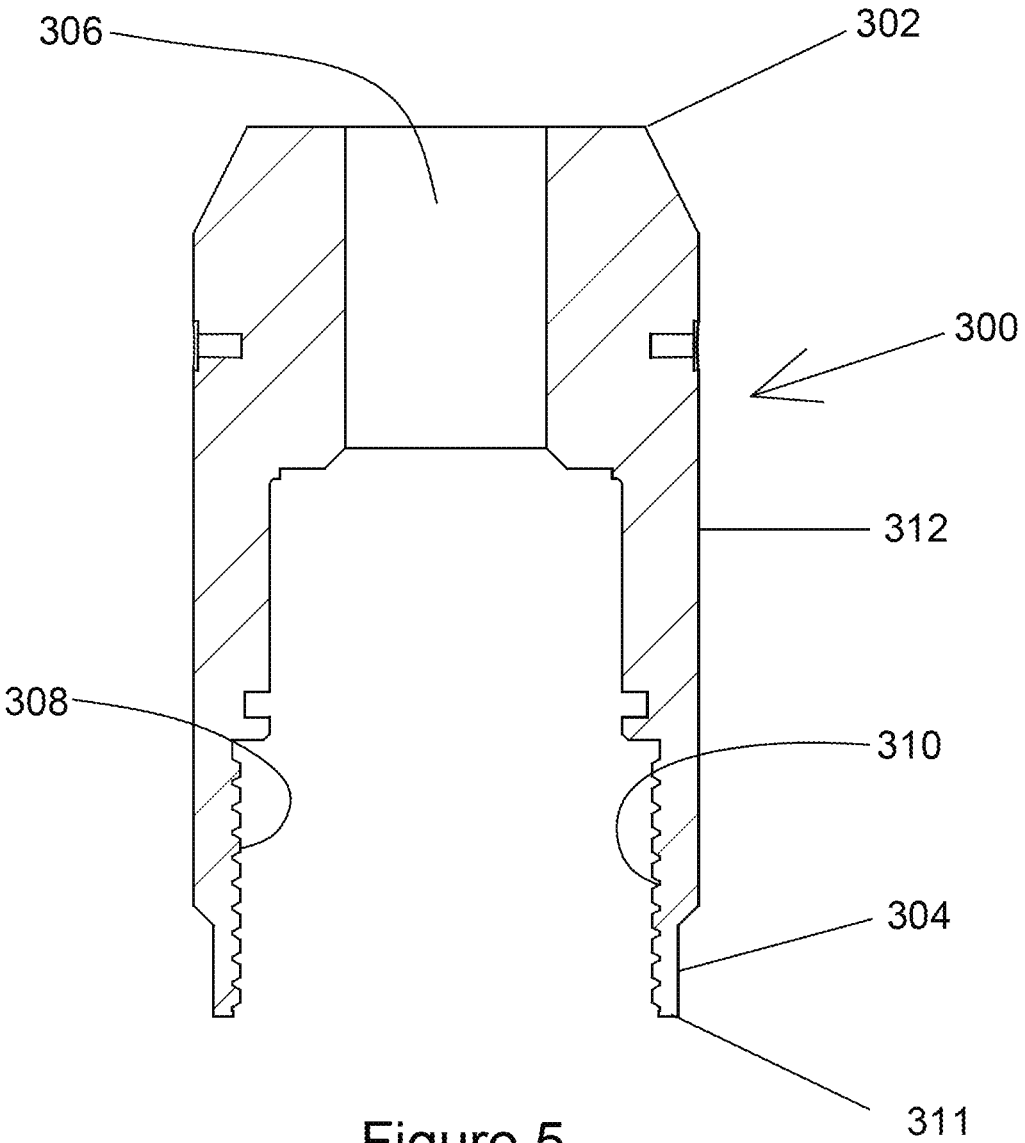
FIG. 5 depicts a side cutaway view of a tubing hanger running tool.

FIG. 5 is a side cutaway view of a tubing hanger running tool 300. Tubing hanger running tool 300 has an upper end 302, a lower end 304, a radially outward surface 312, and a throughbore 306. On a radially inward surface 308 of the throughbore 306 is a left hand thread 310. The left hand threads 310 on the radially inward surface 308 of the throughbore 306 match the left hand threads 126 on the radially outward surface 116 of energizing sleeve 100. On the lower end 304 of the running tool 300 is shoulder 311.

Figure 6:
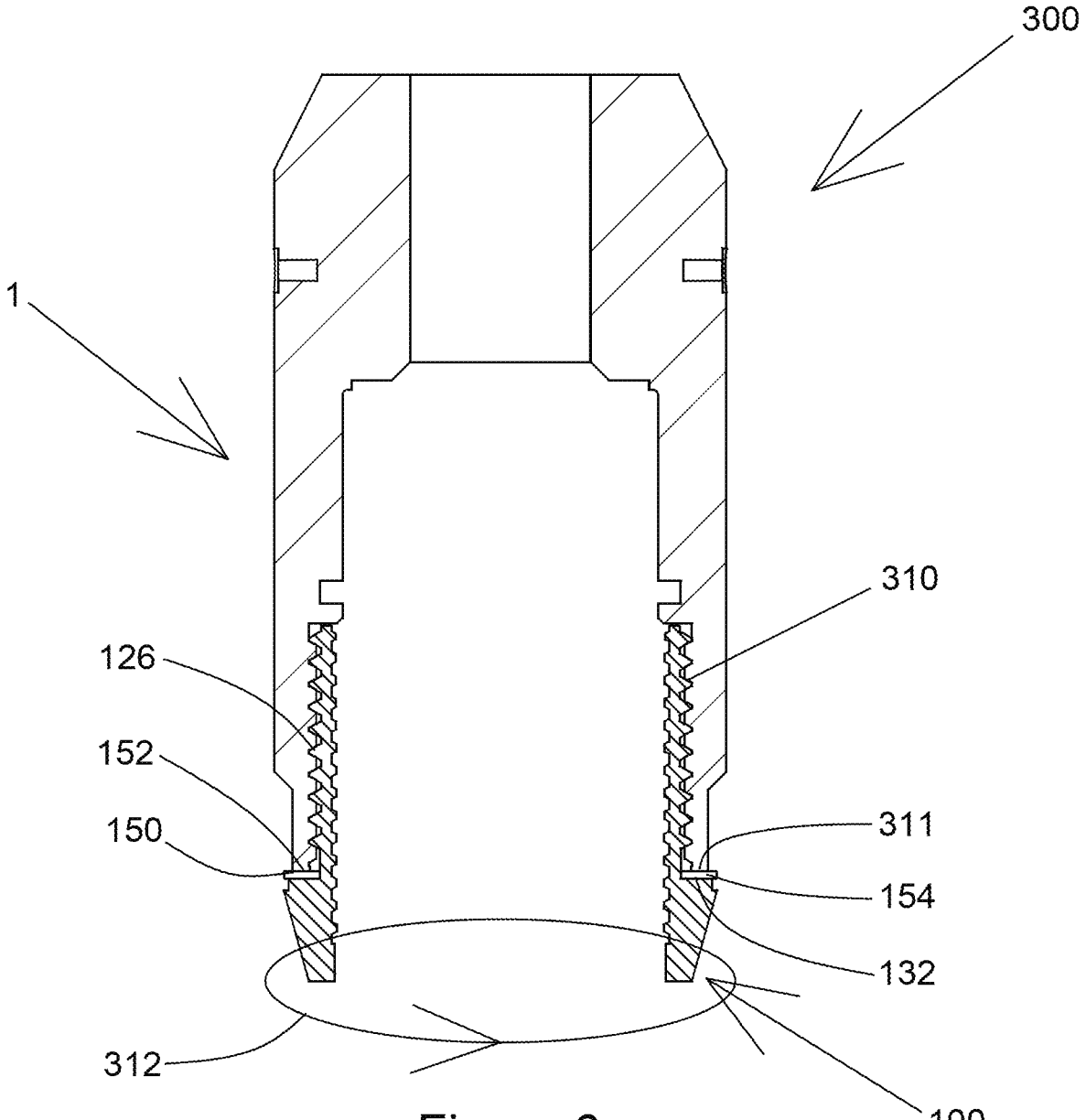
FIG. 6 depicts a side cutaway view of an assembly consisting of the tubing hanger running tool, torque ring, and energizing sleeve.

FIG. 6 is a side cutaway view of assembly 1 consisting of the tubing hanger running tool 300, torque ring 150, and energizing sleeve 100. The circumferentially extending torque ring 150 is placed over energizing sleeve 100 and is moved towards the lower end 112 of energizing sleeve 100 until the lower shoulder 154 of torque ring 150 contacts shoulder 132 of protrusion 122. The hanger running tool 300 is threaded onto energizing sleeve 100 where the left hand threads 116 of energizing sleeve 100 cooperate with the left hand threads 310 of the tubing hanger running tool 300 as the tubing hanger running tool 300 is threaded onto energizing sleeve 100 until the lower shoulder 311 of the tubing hanger running tool 300 contacts the upper shoulder 152 of the torque ring 150. With the lower shoulder 154 of the torque ring 150 against shoulder 132 of the energizing sleeve 100 and the upper shoulder 152 of the torque ring 150 against the lower shoulder 311 of the tubing hanger running tool 300, further rotation of the tubing hanger running tool 300 with respect to the energizing sleeve 100 compresses torque ring 150 and thereby requires increasing torque as torque ring 150 is further compressed. Generally, the desired torque is in a range of from 200 to 400 foot-pounds of torque and preferably about 300 foot-pounds of torque is utilized to compress torque ring 150 to the desired value however in any event the amount of torque required to unscrew the tubular that the running tool is run into the well on, generally about 1500 foot-pounds of torque, is not to be exceeded. With the torque ring 150 torqued to the desired specification assembly 1 is complete.

Figure 7:
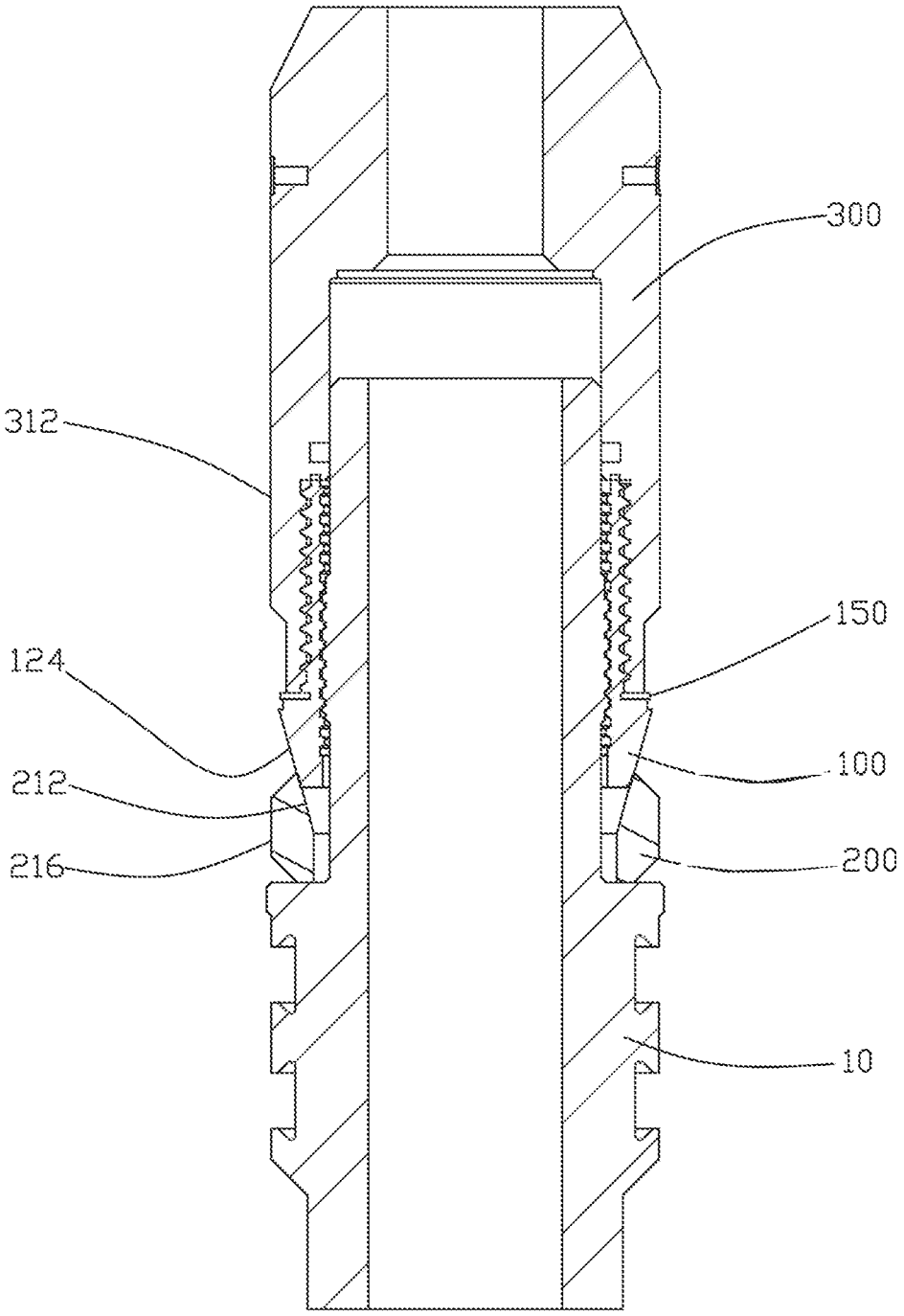
FIG. 7 depicts a side cutaway view of the assembled inwardly biased tubing hanger and running tool in an unlocked condition.

FIG. 7 is a side cutaway view of the assembled inwardly biased tubing hanger 500 and running tool 300 in an unlocked condition. In the unlocked condition the outer surface 216 of the inwardly biased locking ring 200 extends to about the outer diameter of the radially outward surface 312 of the tubing hanger running tool 300. The radially outward outwardly angled surface 124 of the energizing sleeve 310 contacts radially inward angled surface 212 of the inwardly biased locking ring 200.

Figure 8:
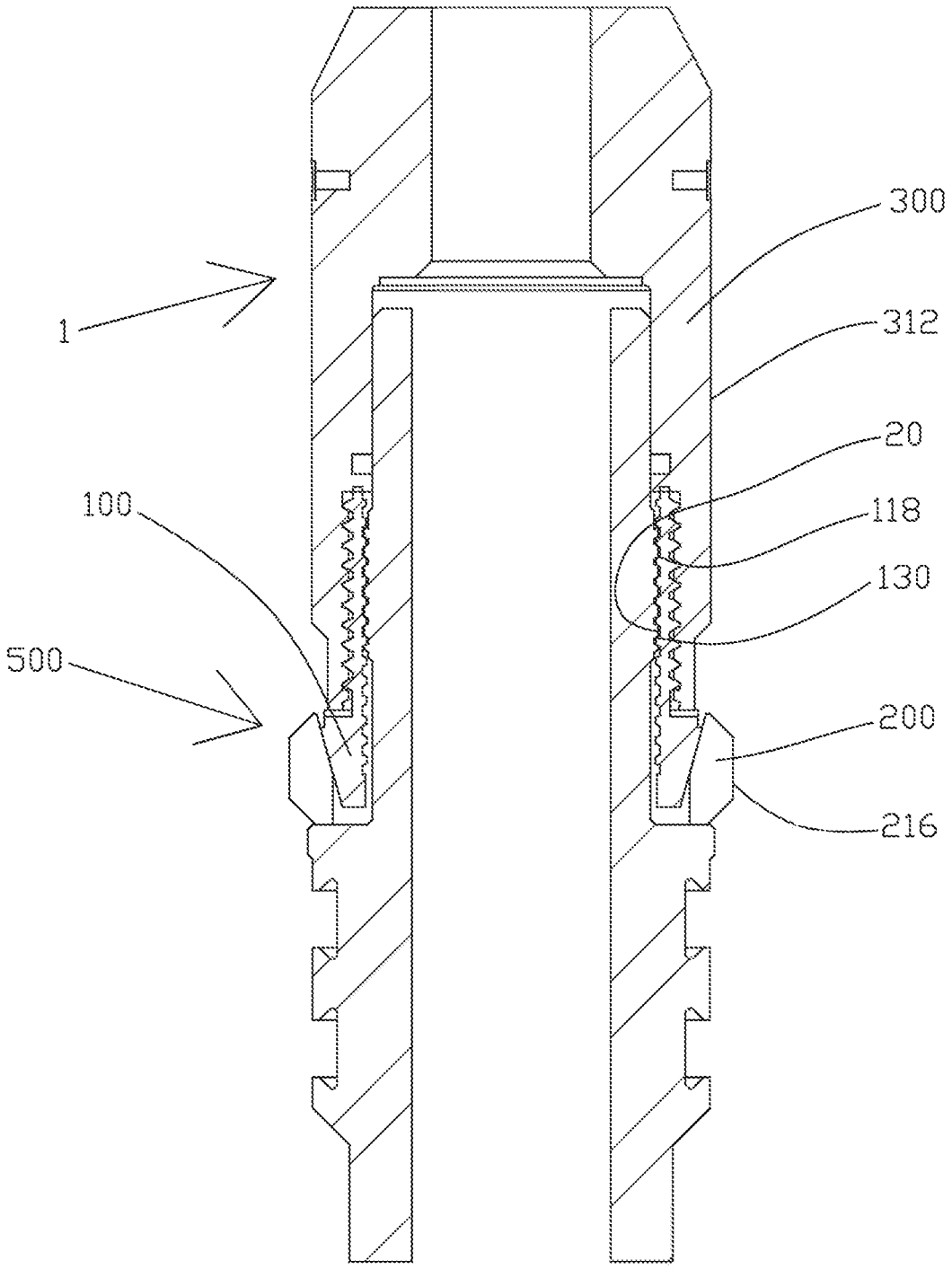
FIG. 8 depicts a side cutaway view of the assembled inwardly biased tubing hanger and running tool in a locked condition.

FIG. 8 is a side cutaway view of the assembled inwardly biased tubing hanger 500 and running tool 300 in a locked condition. In the locked condition the outer surface 216 of the inwardly biased locking ring 200 extends beyond the outer diameter of the radially outward surface 312 of the tubing hanger running tool 300. Preferably the outer surface 216 of the inwardly biased locking ring 200 extends fully into a cooperating groove within the tubular in which the inwardly biased tubing hanger 500 and running tool 300 are placed.

To extend the inwardly biased locking ring 200 into the cooperating groove (not shown), assembly 1 is turned, here to the right, so that right hand threads 20 of the tubing hanger mandrel 10 and the right-hand threads 130 of the radially inward surface 118 of the energizing sleeve 100 cooperate to move the energizing sleeve 100 downward with respect to the inwardly biased locking ring 200. As the energizing sleeve 100 moves downward angle A on protrusion 124 of the energizing sleeve 100 cooperates with angle B on the radially inward surface of the inwardly biased locking ring 200.

Figure 9:
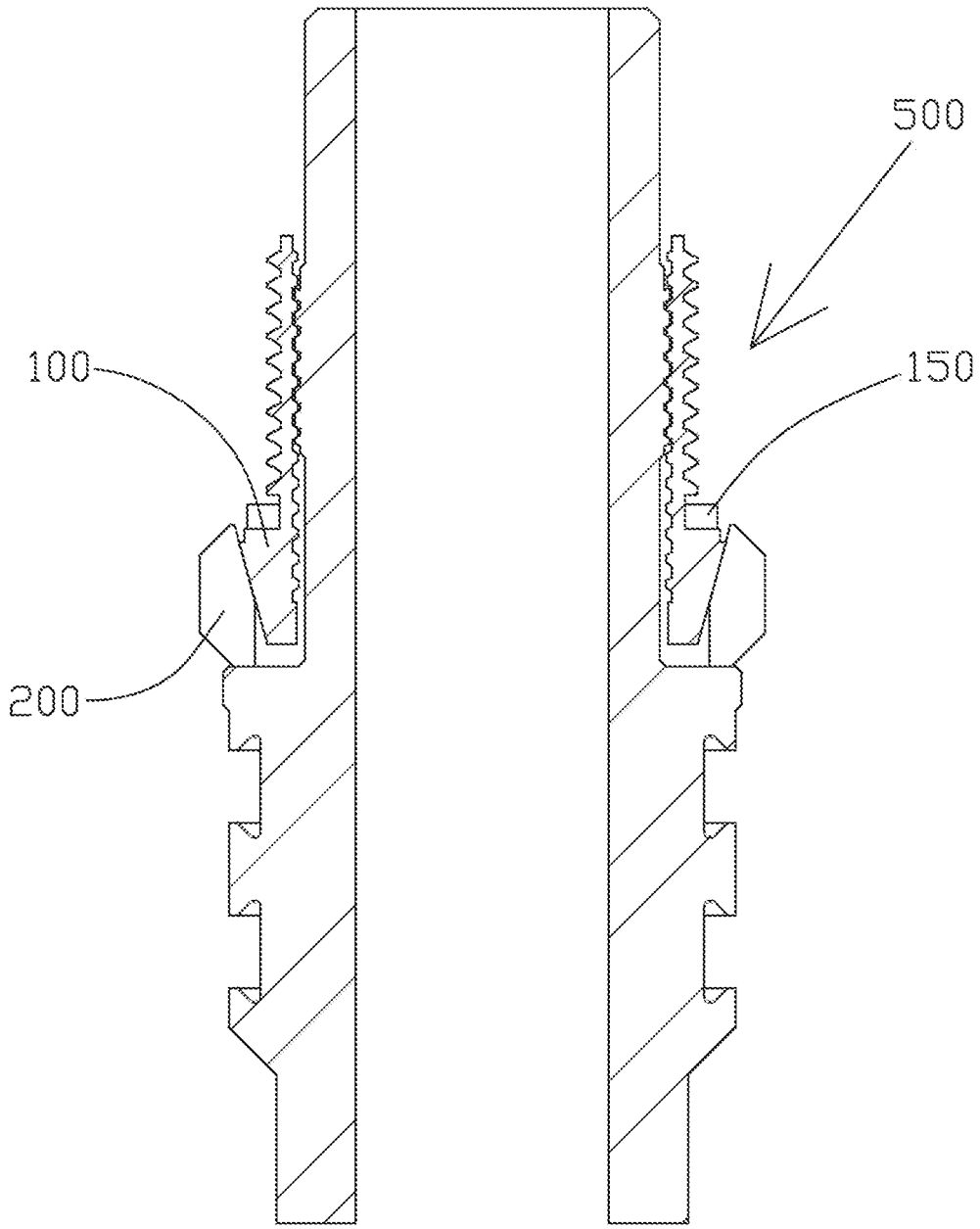
FIG. 9 depicts inwardly biased tubing hanger locked in place by the inwardly biased locking ring and the running tool removed.

As assembly 1 continues to turn to the right the outer surface 216 of the inwardly biased locking ring 200 is constrained within the groove (not shown). Once the maximum extension of the inwardly biased locking ring 200 is reached further turns to the right increase the torque applied to torque ring 150. Upon reaching, and in some cases slightly surpassing due to friction within the assembly 1, the amount of torque applied to torque ring 150 in order to initially lock the running tool 300 to the energizing sleeve 100 the hanger running tool 300 will, due to the left hand threads and the limiting torque of torque ring 150 begin to turn to the right with respect to the energizing sleeve 100. As the hanger running tool 300 continues to turn to the right the hanger running tool 300 will unthread and completely release energizing sleeve 100 with energizing sleeve 100 release the hanger tool may be lifted out of the hole. Leaving the inwardly biased tubing hanger 500 locked in place with the inwardly biased locking ring 200 extended as depicted in FIG. 9.

The nomenclature of leading, trailing, forward, rear, clockwise, counterclockwise, right hand, left hand, upwards, and downwards are meant only to help describe aspects of the tool that interact with other portions of the tool.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An inwardly biased tubing hanger and running tool comprising:

a mandrel having a first radially outward surface and a shoulder, wherein the mandrel has a first thread on the first radially outward surface, a torque ring, wherein, the torque ring is on a radially outward surface of the energizing sleeve and retained by an upward shoulder on the energizing sleeve, wherein, the mandrel engages the torque ring, an energizing sleeve having a first radially inward surface and a second radially outward surface, wherein the first radially inward surface has a second thread that cooperates with the first thread on the first radially outward surface, and further wherein the second radially outward surface has a third thread, an inwardly biased lock ring, a running tool having a second radially inward surface, wherein the second radially inward surface has a fourth thread that cooperates with the third thread on the energizing sleeve's second radially outward surface.

2. The inwardly biased tubing hanger and running tool of claim 1 wherein, the mandrel and the energizing sleeve are rotated about the first thread and the second thread to compress the torque ring.

3. The inwardly biased tubing hanger and running tool of claim 1 wherein, the mandrel and the energizing sleeve are rotated about the first thread and the second thread with between 200 foot-pounds of torque and 400 foot-pounds of torque.

* * * * *